US008303770B2

(12) United States Patent
Orgård

(10) Patent No.: US 8,303,770 B2
(45) Date of Patent: Nov. 6, 2012

(54) METHOD AND ARRANGEMENT FOR THE TREATMENT OF CELLULOSE PULP

(75) Inventor: Jonas Orgård, Stöde (SE)

(73) Assignee: Metso Paper, Inc. (FI)

( * ) Notice: Subject to any disclaimer, the term of this patent is extended or adjusted under 35 U.S.C. 154(b) by 522 days.

(21) Appl. No.: 12/516,429

(22) PCT Filed: Nov. 15, 2007

(86) PCT No.: PCT/SE2007/050850

§ 371 (c)(1),
(2), (4) Date: May 27, 2009

(87) PCT Pub. No.: WO2008/066475

PCT Pub. Date: Jun. 5, 2008

(65) Prior Publication Data

US 2010/0024996 A1 Feb. 4, 2010

(30) Foreign Application Priority Data

Nov. 30, 2006 (SE) ..... 0602570

(51) Int. Cl.
*D21C 9/02* (2006.01)
*D21C 9/06* (2006.01)

(52) U.S. Cl. ..... 162/60

(58) Field of Classification Search ..... 162/55, 162/60, 252, 254
See application file for complete search history.

(56) References Cited

U.S. PATENT DOCUMENTS 7,695,591 B2 * 4/2010 Lundberg et al. ..... 162/52

FOREIGN PATENT DOCUMENTS

| | | |
|---|---|---|
| SE | 528721 C2 * | 1/2007 |
| WO | 9710380 | 3/1997 |
| WO | 2006130097 | 12/2006 |
| WO | 2006130109 | 12/2006 |

OTHER PUBLICATIONS

International Search Report, PCT/SE2007/050850, dated Feb. 18, 2008.

* cited by examiner

*Primary Examiner* — Anthony Calandra
(74) *Attorney, Agent, or Firm* — Lerner, David, Littenberg, Krumholz & Mentlik, LLP

(57) ABSTRACT

A washer for washing and dewatering cellulose pulp is disclosed including a rotatable drum with a plurality of axial compartment walls defining a plurality of outer compartments, a stationary cylindrical casing enclosing the drum, and at least one axially disposed seal dividing the annular space between the stationary casing and the drum into a number of zones for treating the pulp. The function of the seals is optimized by units for seal adjustment which include a load cell for registering a pulse signal indicating the force acting on the seals, an extractor for deriving a pulse height parameter from the registered pulse signal and a motor for moving the seal radially with respect to the drum based on the pulse height parameter.

6 Claims, 6 Drawing Sheets

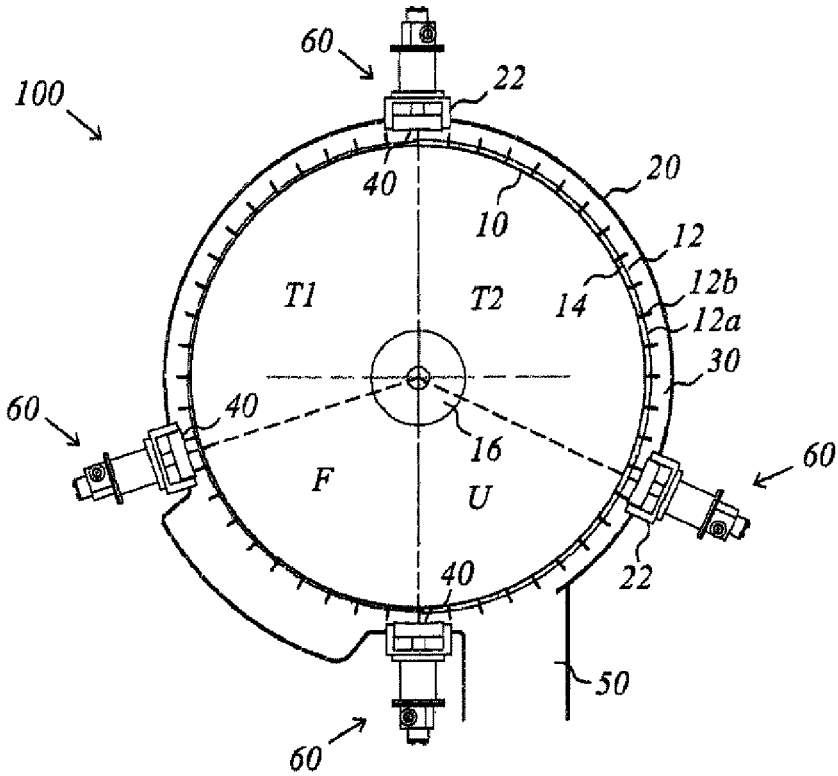
FIG. 3
FIG. 4A
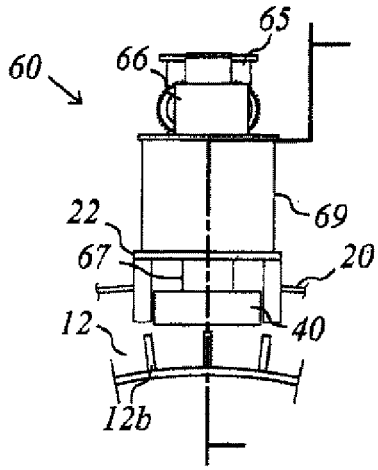
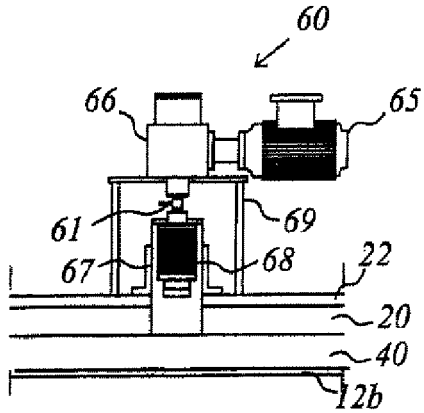
FIG. 4B

METHOD AND ARRANGEMENT FOR THE TREATMENT OF CELLULOSE PULP

CROSS-REFERENCE TO RELATED APPLICATIONS

The present application is a national phase entry under 35 U.S.C. §371 of International Application No. PCT/SE07/050850 filed Nov. 15, 2007, published in English, which claims the benefit of Swedish Application No. 0602570-4, filed Nov. 30, 2006. The disclosures of said applications are incorporated by reference herein.

FIELD OF THE INVENTION

The present invention relates to a washer for washing and dewatering of cellulose pulp of the type comprising a compartmented drum.

BACKGROUND OF THE INVENTION

All fiber lines comprise some type of washing equipment to separate the liquor of the digestion from the pulp. Later on in the process a washer is provided to separate bleaching liquors after bleaching stages. There are a number of different types of washers operating according to different principles.

A well-known type of washer is the drum washer, where the pulp is dewatered on a rotating filter drum after the addition of washing liquid, which displaces the liquor remaining on the pulp web after the preceding process stage, for example a digestion stage or a bleaching stage. An underpressure inside the drum causes the displaced liquid to pass through a perforated metal sheet arranged on the rotating drum. A further development of the original drum washer is the pressurized displacement washer, where the filtrate, at an overpressure, is brought to pass through the metal sheet. The increase in pressure difference leads to a more efficient filtrate displacement.

According to a known design of a pressurized displacement washer, the drum is provided with compartments, extending in the axial direction of the drum and intended to be filled with pulp. The compartments are defined by walls in the form of bars arranged axially along the entire drum shaft, as well as a bottom formed by the perforated metal sheet. The compartmentalization of the drum ensures that the pulp cake does not break up and get transported away, but instead maintains the shape which is produced upon application of the pulp. The perforated metal sheet, on which the pulp is deposited, is located at a distance from the main surface of the drum, so that filtrate channels are formed in the space between the drum and the metal sheet. Along the circumference of the drum there are at least as many filtrate channels as pulp compartments.

In a drum washer, a plurality of different washing stages can be carried out, with separate addition of washing liquid to the different stages, and also re-cycling of filtrate from one stage for use as washing liquid in another stage. In order to achieve maximum washing efficiency, it is desirable that washing liquid intended for a particular washing stage is not transferred to a later washing stage. (Due to a pressure difference between the stages, the supplied washing liquid tends to be transported towards the lower pressure.) In order to be able to separate different washing stages, which are carried out in one or more washing zones of the drum, and forming stages, which are carried out in the forming zone of the drum, and discharge stages, which are carried out in a discharge zone of the drum (a zone for enhanced pulp concentration constitutes a first part of the discharge zone), the respective zones are sealed by longitudinal (i.e. axial) seals. These longitudinal seals are arranged between the rotary drum and the surrounding casing. The filtrates from the respective zones are separated by seals in a peripheral end valve arranged at one or both of the end walls of the drum.

A problem associated with drum washers of the type that has zones separated by means of longitudinal seals is that these seals are exposed to abrasion, wear and other stresses. The seals change over time, which affects the general wash performance in a negative manner and also leads to risks for leakage and production interruptions.

According to the prior art, there is a possibility for a working staff to make a manual adjustment of the longitudinal seals. The principle is to wheel the seal in the direction towards the drum until the staff perceives a sound which serves to indicate that the seal lies in close contact with the drum and thereafter back the seal an arbitrary distance. Such procedures are circumstantial, irregular and completely dependent on personal qualities of the working staff.

Accordingly, there is a need for an improved solution to the problem with seals that are worn and change over time.

One general object of the present invention is to provide an improved washing apparatus of the kind with a compartmented rotatable drum. In particular, the invention aims at accomplishing a more secure and more efficient seal mechanism of the washing apparatus.

SUMMARY OF THE INVENTION

In accordance with the present invention, these and other objects have now been realized by the invention of a method for adjusting the seal in a washer for washing and dewatering a cellulose pulp comprising a rotatable drum including a plurality of axial compartment walls distributed along the circumference of the drum defining a plurality of outer compartments for washing the cellulose pulp, a stationary cylindrical casing enclosing the drum, defining an annular space between the stationary cylindrical casing and the rotatable drum, and at least one axially disposed seal dividing the annular space into a plurality of zones for forming, washing and discharging the pulp, the method comprising registering a pulse signal indicating the force acting on the at least one axially disposed seal in a direction relative to the drum, the pulse signal corresponding to contact between the plurality of axial compartment walls and the at least one axially disposed seal, deriving a pulse height parameter from the registered pulse signal; and moving the at least one axially disposed seal substantially in the radial direction of the drum in a predetermined manner based on the pulse height parameter. Preferably, the pulse height parameter is based on the amplitude of the pulse signal or on the peak-to-peak value of the pulse signal.

In accordance with one embodiment of the method of the present invention, the pulse signal comprises a force signal registered by measuring the force acting on the at least one axially disposed seal in a direction relative to the drum. In accordance with another embodiment of the method of the present invention, the pulse signal comprises a pressure signal registered by measuring the pressure in the liquid of a hydraulic system.

In accordance with another embodiment of the method of the present invention, the method comprises substantially continuously registering the pulse signal and adjusting the at least one axially disposed seal when the washer is operating.

In accordance with another embodiment of the method of the present invention, the moving of the at least one axially disposed seal occurs if the pulse height parameter is smaller than a predetermined minimum value or larger than a predetermined maximum value.

In accordance with the present invention, these and other objects have also been realized by the invention of apparatus for adjusting a seal in a washer for washing and dewatering a cellulose pulp, the apparatus comprising a rotatable drum including a plurality of axial compartment walls distributed along the circumference of the drum defining a plurality of outer compartments on the drum, a stationary cylindrical casing enclosing the drum, defining an annular space between the stationary cylindrical casing and the drum, at least one seal axially dividing the annular space into a plurality of zones for forming, washing and discharging the pulp, a measuring cell for registering a pulse signal indicating the force acting on the at least one longitudinal seal in a direction relative to the drum, the pulse signal corresponding to contact between the plurality of axial compartment walls and the at least one seal, an extractor for deriving a pulse height parameter from the registered pulse signal, and moving means for moving the at least one seal substantially in the radial direction of the drum in a predetermined manner based on the pulse height parameter. In a preferred embodiment, the pulse height parameter is based on the amplitude of the pulse signal or the peak-to-peak value of the pulse signal.

In accordance with one embodiment of the apparatus of the present invention, the apparatus is adapted for substantially continuously adjusting the at least one seal during operation.

In accordance with another embodiment of the apparatus of the present invention, the measuring cell is adapted to register the force acting on the at least one seal in a direction from the drum.

In accordance with another embodiment of the apparatus of the present invention, the measuring cell comprises a pressure sensor adapted to register the pressure in the liquid of a hydraulic system.

In accordance with another embodiment of the apparatus of the present invention, the moving means comprises a positioning member which holds the at least one seal in the radial direction of the drum, and drive means for driving the movement of the at least one seal by affecting the positioning member. In a preferred embodiment, the moving means further comprises a spring force-based member cooperating with the drive means, whereby the spring force-based member is activated only upon a predetermined substantial change in the measured force.

In accordance with another embodiment of the apparatus of the present invention, the apparatus includes a control unit for collecting the pulse signal from the measuring cell and transmitting a control signal to the moving means based on the pulse height parameter.

In accordance with another embodiment of the apparatus of the present invention, the apparatus includes at least two measuring cells associated with the at least one seal, and an individually controlled moving means, whereby the connection between the moving means and the at least one seal is pivoted, whereby different parts of the at least one seal can be moved independently of each other.

In accordance with the present invention, a washer for washing and dewatering cellulose pulp has been invented comprising a rotatable drum having a plurality of axial compartment walls distributed along the circumference of the drum defining a plurality of outer compartments for washing the cellulose pulp, a stationary cylindrical casing enclosing the drum defining an annular space between the stationary cylindrical casing and the drum, and at least one seal dividing the drum into a plurality of zones for forming, washing and discharging the cellulose pulp, and apparatus for adjustment of the at least one seal as set forth above.

Briefly, the present invention provides a compartmented washing apparatus with adjustment of at least one longitudinal (i.e. axial) seal based, directly or indirectly, on the force that acts on the seal in a direction radially outwardly from the drum. The force is measured, for example with a load cell or the like, and based thereon the seal is moved when necessary, such as when the seal gets too close to the drum due to wear or deformation of the drum or when there is an unfamiliar object between the seal and the drum. It has appeared that the registered force signal presents repeated pulses (fluctuations) corresponding to the respective contacts between the compartment walls of the drum and the longitudinal seal as the drum rotates. The size of the force pulses increases the closer the drum is to the seal. Based on this knowledge, it is proposed according to the present invention that the seal adjustment, i.e. the movement in a radial direction, is performed based on a parameter comprising a measure of the pulse height of the measured pulse signal. The movement of the seal is accomplished by means of a motor, hydraulics or another drive means, normally connected to the seal over one or more intermediary members and/or positioning means.

This proposed seal adjustment enables washing apparatuses with "self sensing" seal arrangements where the seal is automatically adjusted in towards the drum or out from the drum when needed. The seal adjustments can thus be performed independently of the personal qualities and perceptional abilities of the working staff. Among other things, the present invention enables compensation for changes in the position of the longitudinal seals in relation to the drum as a result of deformations of the drum washer upon changed operational conditions. A more secure sealing function is obtained, the risk of leakage is considerably reduced, and operation of the washer drum can be optimized such that the washing process provides better results. The registering of the pulse signal and the adjustment of the seal is preferably substantially continuous when the washing arrangement is in operation.

Thus, according to the present invention there is provided a washer for washing and dewatering of cellulose pulp, which washing arrangement comprises a rotatable drum with a plurality of outer compartments on the drum for the pulp to be washed, which compartments are defined by axial compartment walls distributed along the circumference of the drum, a stationary cylindrical casing which encloses the drum, whereby an annular space is defined between the casing and the drum, and where the annular space is divided into zones for forming, washing and discharge of the pulp by longitudinal seals in the axial direction of the drum, the washer comprising a unit for seal adjustment including measuring means for registering a pulse signal that indicates the force acting on one of the longitudinal seals in a direction from the drum, the pulses of the pulse signal corresponding to respective meetings or contacts between the compartment walls of the drum and the longitudinal seal, extracting means for extracting a pulse height parameter from the registered pulse signal, and moving means for moving the longitudinal seal substantially in the radial direction of the drum in a predetermined manner based on the pulse height parameter.

According to one embodiment of the present invention, the pulse signal comprises a force signal registered by measuring the force acting on one of the longitudinal seals in a direction from the drum. The pulse signal may also comprise e.g. a pressure signal registered by measuring the pressure in the liquid of a hydraulic system, whereby an indication of the force is obtained through indirect force measuring.

The pulse height parameter can, for example, be based on the amplitude or "peak-to-peak" value of the pulse signal. The pulse height parameter is relative and is not affected by which balance position ("zero position") the force fluctuates around. This means that changes of this level due to changed conditions of operation or changed measuring equipment do not deteriorate operation of the seal adjustment. The seal can be adjusted continuously by a comparatively slow adaptation instead of quickly being backed upon contact with the drum. Normally, the seal will not have to enter the position where it hits the drum, leading to a more "smooth" operation and less load on the components of the washing arrangement. Another advantage of the seal adjustment according to the present invention is that it can handle a jammed seal in an appropriate manner.

Furthermore, there may be at least two measuring means arranged in connection with the longitudinal seal together with a respective individually controlled moving means. By means of a pivoted (articulated) connection between the moving means and the seal, different parts of the seal may be moved independent of each other.

According to a particular embodiment of the present invention, the moving means comprises positioning means that holds the seal in the radial direction of the drum, as well as a drive means that drives the movement of the seal by, directly or indirectly, affecting the positioning means. The moving means may further comprise a spring force-based means, which is adapted to co-operate with the drive means such that the spring force-based means comes into force upon substantial (rapid and comparatively large) changes of the force. Moreover, there is in general a control unit which is arranged to collect a pulse signal from the measuring means and transmit a control signal to the moving means based on pulse height information extracted from the pulse signal.

According to other aspects of the present invention, a unit for seal adjustment is provided, and also a method for seal adjustment.

BRIEF DESCRIPTION OF THE DRAWINGS

The present invention, as well as further objects and advantages thereof, is best understood by reference to the following detailed description, and the attached drawings, wherein:

FIG. 3 is a side, schematic, elevational, cross-sectional view through a washing apparatus with a compartmented drum in accordance with one embodiment of the present invention;

FIG. 4A is a front, elevational, cross-sectional view of a washing apparatus having a longitudinal seal as well as a unit for seal adjustment in accordance with one embodiment of the present invention;

FIG. 4B is a side, elevational, cross-sectional view of the washing apparatus shown in FIG. 4A;

DETAILED DESCRIPTION

Throughout the drawings, the same reference numbers are used for similar or corresponding elements.

A "meeting" between a compartment wall and seal in this description refers to the state/the point in time when a seal and a compartment wall will be at least partly at corresponding positions as seen radially. This meeting does not have to imply any physical contact.

Figure 1:
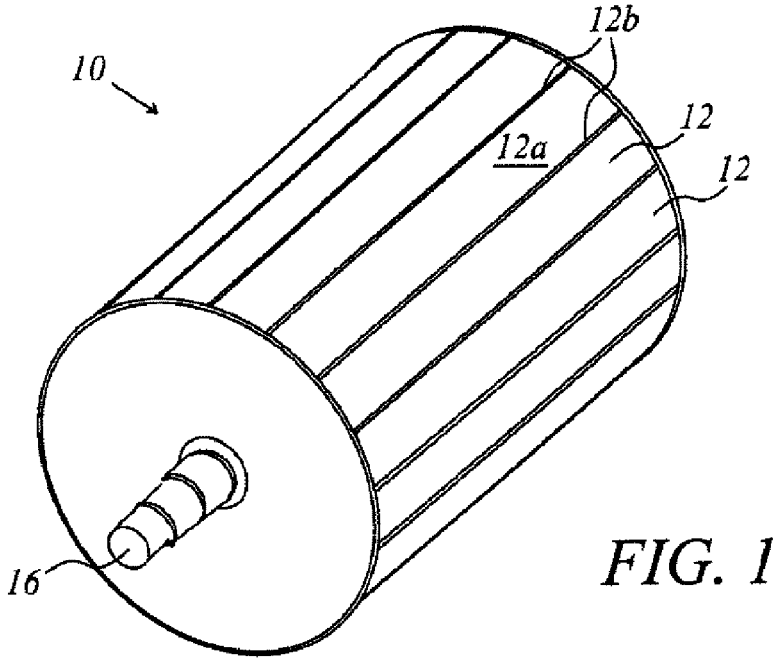
FIG. 1 is a side, schematic, perspective view of a compartmented rotatable drum that can be used in a washing apparatus according to the present invention.

FIG. 1 is a schematic perspective view of a compartmented rotatable drum that can be included together with a stationary casing in a pressurized displacement washer according to the present invention. A rotatable drum 10 provided with a plurality of outer compartments (also referred to as pulp compartments or cells) 12 is shown, in which compartments the paper pulp to be washed is placed during feeding towards the drum. Each compartment 12 has a bottom 12*a* of perforated sheet metal as well as two compartment walls (cell walls) 12*b* arranged axially with reference to the shaft 16 of the drum. The compartment walls 12*b* of the drum illustrated in FIG. 1 are evenly distributed along the circumference of the drum. The rotatable drum 10 is in general rotatably mounted on a stationary support (not shown) in the washing apparatus and is enclosed by a cylindrical casing (20 in FIG. 2 e.g.), whereby an annular space 30 is defined between the casing and the drum.

Figure 2:
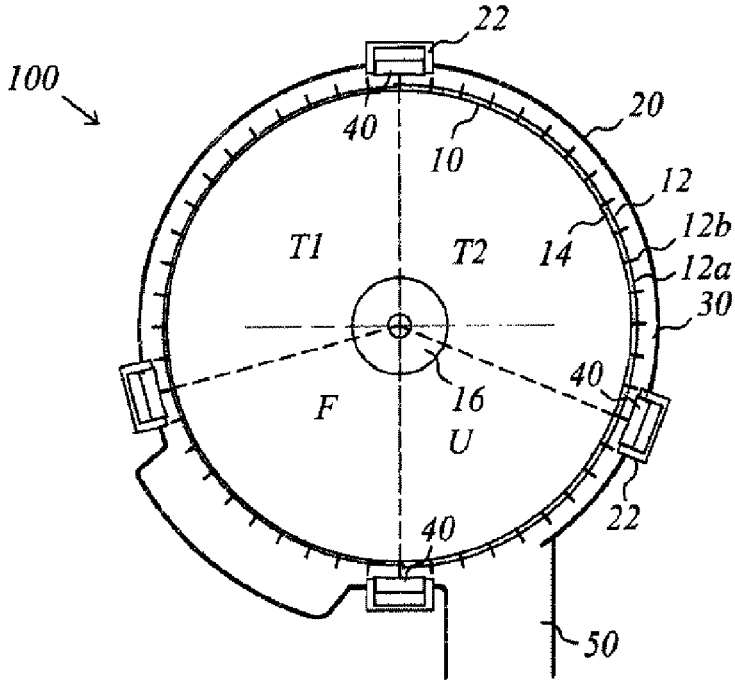
FIG. 2 is a side, schematic, elevational, cross-sectional view through a prior-art washing apparatus with a compartmented drum.

FIG. 2 shows an axial cross-section through a washing apparatus with a compartmented rotatable drum according to the state of the art. The washing apparatus 100 comprises a plurality of axial longitudinal seals 40 arranged between the rotatable drum 10 and the surrounding casing 20. These longitudinal seals 40 seal between the casing 20 and the compartment walls 12*b* of the compartments and serve as separating members between different zones, F, T1, T2, and U, of the washing apparatus 100. The function of the seals 40 is of great importance e.g. in order to make sure that washing liquid intended for a specific washing stage is not moved to a subsequent washing stage, in particular since there can be a difference in pressure between different washing stages. In FIG. 2 four longitudinal seals 40 are shown, thus dividing the annular space 30 into four zones, more specifically into a forming zone F for forming the pulp onto the compartments 12 of the drum, first and a second washing zones, T1 and T2, for washing the formed pulp, and a discharge zone U for discharging the washed pulp.

Each seal 40 has a width somewhat larger than the distance between two adjacent compartment walls 12*b*. Consequently, the compartment walls 12*b* will pass the seal 40 one by one as the drum 10 rotates and the position of the seal is such that it at each point in time "covers" either one or two compartment walls 12*b*. Further, the seal may extend in the axial direction e.g. extend in principle along the entire drum. Alternatively, the drum may present two (or more) separate seals in the axial direction, such as when the drum is provided with an annular structure that divides every compartment into two sub-compartments in the axial direction, whereby the filtrate can be conducted away from both of the end walls of the drum.

The rotatable drum 10, including the compartment walls 12*b* thereof, is normally made of steel. The longitudinal seals 40 may also be made of a metal material, but can with advantage be made of a polymer material, intended to be replaced by means of particular opening parts 22 in the casing 20.

A drum washer 100 of the above described design is run with continuously rotating drum 10 according to the following principle. Pulp to be washed is fed into the forming zone F (the inlet is not shown), whereby the pulp is placed in the compartments 12 on the drum 10 forming, in the axial direction of the drum, long and narrow rectangles on the perforated metal sheet which constitutes the bottom of the compartments 12*a*. The compartmentalization of the drum makes sure that the formed pulp cake structure is maintained. Washing liquid is supplied to the annular space 30 and filtrate is squeezed out of the pulp and thereby passes through the perforated metal sheet. Preferably, this occurs at an overpressure in order to obtain improved dewatering of the pulp. The perforated metal sheet is placed at a distance from the drum 10 such that filtrate channels 14 are formed in the space between the drum 10 and the perforated metal sheet. The washing may, as in FIG. 2, be repeated in two or more stages at different pressure and using separate washing liquids. Used liquid is usually brought back to a preceding washing stage, or led out of the washing apparatus 100 and to a previous process stage. The washed pulp is discharged through an outlet opening 50.

As mentioned in the above background section, the longitudinal seals of the drum wash are exposed to abrasion, wear and other stresses. The seals change over time, which affects the general washing performance in a negative way and also leads to risks of leakage and operation interruptions. Occasionally, various objects, such as chips or metal sheet parts, may also enter between a seal and the drum, whereby the function of the seal is considerably impaired and leakage may arise. As mentioned in the background section, in such cases the prior art suggests manual adjustments of a more or less arbitrary nature.

In particular, it has been observed that the position of the longitudinal seals of the drum washer is altered and displaced in response to varying conditions of operation. Varying conditions of operation may imply considerable differences in pressure and/or temperature in the washing apparatus, whereby the drum washer presents deformations. Thereby, the respective seal positions change in relation to the drum and the sealing function is affected in a negative way. The aforementioned manual adjustments are particularly unreliable in respect of adjustments for these kinds of changes, which sometimes appear comparatively fast and in an unpredictable way.

According to the present invention, a mechanism for seal adjustment is proposed, which mechanism enables a more sophisticated handling of the longitudinal seals of the washing drum. FIG. 3 shows a washing apparatus 100 in a cross-sectional view where units 60 for seal adjustment in accordance with the present invention have been arranged in association with the longitudinal (axial) seals 40. Each unit 60 for seal adjustment comprises a measuring means for direct or indirect measuring of the force that acts on the seal 40 in a direction from the drum 10 and also a moving means for subsequent movement of the seal 40 according to a predetermined pattern based on the measured force. When the seal 40 gets so close that it lies in contact with (bears against) the compartment walls 12*b*, the force is strikingly changed, which can be referred to as that a contact force acts away from the drum 10 towards the seal 40. Before it gets into contact with the drum, the seal is also affected by a force in a direction from the drum. The force has been shown to behave as a pulse signal, i.e. it fluctuates around a specific value/interval, when the seal is located in the area around the drum (in the vicinity of the drum or entirely or partly in contact with the drum). The pulses of the signal correspond to the respective meetings between the seal and the compartment walls of the drum when the drum rotates. The closer to the compartment walls of the drum the seal is located, the higher the force pulses become.

According to the present invention, these observations are used by registering the pulse signal that indicates the force on the seal and then adjusting the seal based on a pulse height parameter, which is extracted (read or calculated) from the registered pulse signal. The pulse height parameter provides a measure or an indication of the size or height of the pulses of the signal and can, for example, consist of or be calculated using information about the peak-to-peak value of the pulse signal or its amplitude. Peak-to-peak value here means a measure of the difference between the extremes that the signal oscillates between (between peak and valley; positive and negative peak, resp.). For a regular (theoretical) pulse signal, the amplitude is half the size of the peak-to-peak value.

The pulse height parameter in general comprises a difference between two absolute values and is a relative measure of the force. This property of the pulse height parameter makes the seal adjustment according to the present invention very advantageous since it becomes independent of absolute values and hence independent on which balance position ("zero position") the force fluctuates around. The absolute values vary depending on the position or orientation of the seal and may thus be different at different circumferential positions on the drum also when the other conditions (distance to the drum, surrounding environment, etc) are identical. The level of the pulses may also vary in response to changing conditions of operation as well as be displaced when there has been some time since the measuring equipment was calibrated.

With the proposed seal adjustment, no information on which force a certain position of the seal corresponds to is needed, and the seal can be adjusted continuously by a comparatively slow adaptation instead of being quickly backed upon contact with the drum. Normally, the seal will not have to enter the position where it hits the drum, which e.g. could be a basis for using less resistant components.

Another advantage of the seal adjustment according to the present invention is that is can handle a jammed seal which is stuck and may be subject to a large force (absolute value) even though it is actually located far away from the drum. In such a case, there will be no (or very small) pulses and the system can push the seal further until it breaks free. With a system that reacts on absolute values, a jammed seal could possibly be wrongly interpreted as a seal in contact with the drum and be backed further from the drum leading to problems like leakage.

The proposed seal adjustment is preferably "self sensing" and automatic in the sense that the seal, when needed, is automatically adjusted and moved in towards the drum or backed out from the drum. The seal settings do not depend on the working staff's personal qualities and apprehension. The present invention enables compensation for changes in the position of the longitudinal seals in relation to the drum due to varying conditions of operation and deformations of the drum washer. Such compensation, as well as compensation for wear and other seal changes, may thus be carried out automatically.

A preferred embodiment of the unit 60 for seal adjustment will now be described with reference to FIGS. 4A and 4B, which show a part of a washing apparatus with a unit for seal adjustment in an axial and radial cross-section, respectively. A longitudinal seal 40 of the kind that seals between zones in the washing drum 10 is shown in a position where it is in contact with a compartment wall 12*b*. The illustrated unit 60 for seal adjustment comprises an induction motor 65, a jackscrew 66, a cylinder 67, a spring package 68 and a load cell 61.

A support structure 69, such as a shelf, encloses the load cell 61, the spring package 68 and also a part of the cylinder 67. The cylinder 67 works as a positioning means and holds the longitudinal seal 40 in a radial direction as seen from the drum. Movement of the seal 40 in a substantially radial direction is driven by the electrical motor 65, the rotational movement of which is translated to linear movement via the jackscrew 66. The jackscrew 66 is connected to the cylinder 67 and in this way the drive power of the motor 65 is transferred to the seal 40. (The function of the spring package 68 is described below.) The task of the load cell 61 is to measure the force acting on the seal 40 in a direction substantially radially out from the drum 10. In order to achieve this, it is suitably arranged between the cylinder 67 and the jackscrew 66 as in the example.

An advantage of the force-based seal adjustment described above is that it may be implemented by essentially mechanical measuring equipment, at least in respect of the parts that are arranged within the casing of the washing apparatus. The adjustment unit is therefore suitable for use in the demanding environment in the washing apparatus, where there is pulp suspension between the seal and the drum.

The load cell 61 as well as the motor 65 are preferably connected to a control unit/function (63 in FIG. 8), which for example can be implemented in the form of computer executable algorithms. The control unit collects measured values from the load cell 61 and based thereon it generates control settings for the motor 65 in a predetermined way. This, for example, includes the fact that at least one pulse height parameter of the registered force is calculated and compared against a minimum and maximum value, respectively. If the pulse height exceeds the maximum value, the control unit controls the motor 65 such that it, via the jackscrew 66 and the cylinder 67, moves the seal in a direction from the drum. If the pulse height is lower than the minimum value, the control unit controls the motor 65 such that it, via the jackscrew 66 and the cylinder 67, moves the seal in a direction towards the drum.

Figure 5A:
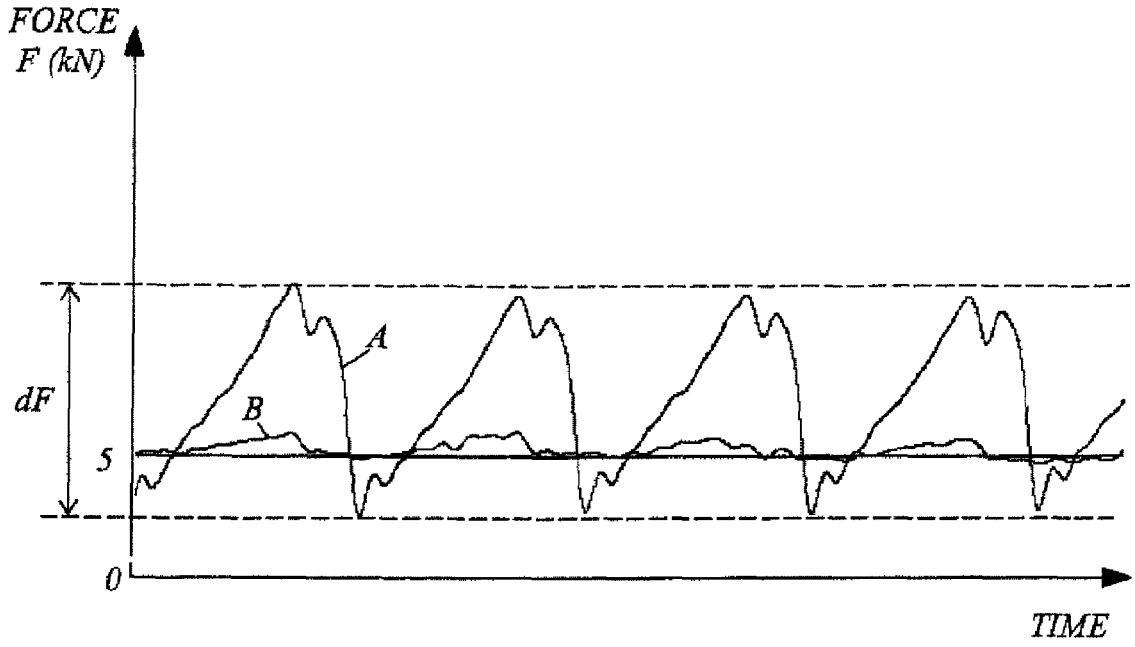
FIG. 5A is a schematic diagram of force as a function of time, registered in accordance with a preferred embodiment of the present invention.
Figure 5B:
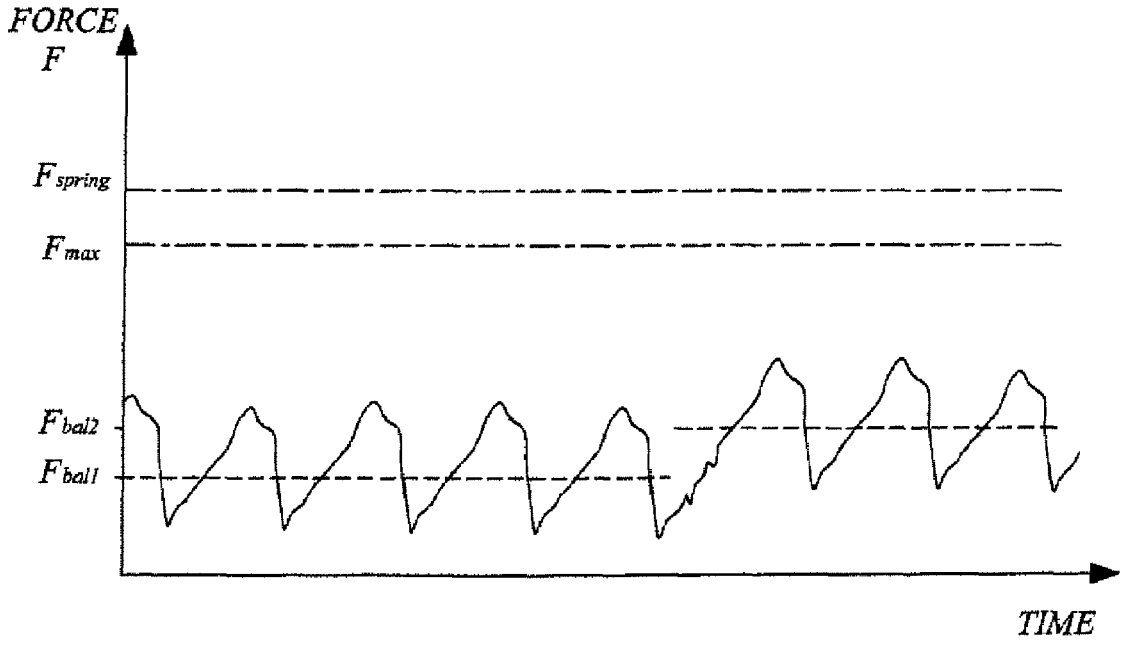
FIG. 5B is a schematic diagram of force as a function of time, registered in accordance with the preferred embodiment of the present invention.

FIGS. 5A and 5B are schematic diagrams of exemplifying force pulse signals registered in accordance with the present invention. In FIG. 5A, two pulse signals, A and B, are shown, illustrating different conditions of one and the same longitudinal seal. The height/size of the pulses of signal A is larger than the height of the pulses of signal B, which means that the seal is closer to the drum in the case which gave rise to signal A than in the case which gave rise to signal B. A pulse height parameter dF is indicated for signal A. In this example the pulse height parameter consists of the peak-to-peak value of the pulse signal. The calculation of dF is preferably performed continuously by the control unit and a person skilled in the art realizes that this can be done in different ways using conventional methods of calculation. For example, one embodiment uses the peak values (local maxima and minima) of the pulse signal for a certain period of time. These are averaged and dF is calculated as the difference between the averages. Another embodiment for a certain period of time replaces the maximum and minimum value, resp., as soon as a new larger or smaller value, resp., is obtained and dF is thereafter calculated as the difference between the largest and the smallest value for that period of time.

The seal control may be in the form of a continuous adaptation of the seal such that dF is kept within a certain acceptable interval, i.e. such that $dF_{min}<dF<dF_{max}$. A significant advantage of this method is evident from FIG. 5B, showing a pulse signal the balance position ("zero position") of which at a certain point in time is displaced from a first level $F_{bal1}$ (absolute value) to a second level $F_{bal2}$. Different balance positions can for example reflect changed conditions of operation or a changed zero position of the measuring means. However, since dF is not affected by the absolute values, a well-functioning seal adjustment is accomplished also after this change.

An advantage of the present invention is that, when more than one of the longitudinal seals of the washing arrangement are provided with respective units for seal adjustment, it is possible to adjust the minimum and maximum value of the pulse height parameter individually. Thus, $dF_{min}$ and $dF_{max}$ do not have to be identical for all seals of the washing arrangement, but may be adapted for example such that some seals are lying against the drum more tight than others.

According to one embodiment of the present invention, the seal adjustment may also comprise a safety function, which reacts if the force on the seal becomes so large that there is a risk of damages on the equipment. Such a safety function, reacting upon contact, can for example be arranged to adjust the seal in the following manner. The measuring means registers the force acting on the longitudinal seal in a direction from the drum more or less continuously. When the force exceeds a threshold $F_{max}$, the system reacts by backing the seal. The threshold $F_{max}$ is an absolute value selected as a safety limit to prevent equipment (sensors etc) from being damaged. If $F>F_{max}$, the seal is backed a certain distance. However, there may be cases where this is not sufficient in order to lower the force, for instance if there is an unfamiliar object left between the seal and the drum. According to one embodiment of the present invention, the system is tuned such that the seal in such cases (in one or several steps) is further backed. $F_{max}$ is indicated in FIG. 5B, and so is yet another safety value $F_{spring}$, the function of which is described below. However, it is to be understood that a unit for seal adjustment according to the present invention is normally kept outside these critical levels and never has to enter the position where the seal lies in contact with the drum.

The input parameters to an algorithm for seal adjustment used in accordance with the present invention in order to perform the above-described functions, typically include the measured force against the seal and there is no need for a distance determination (distance sensor), whereby a seal adjustment that is sophisticated and at the same time comparatively easy to implement is possible. Another advantage of the proposed force-based seal adjustment is that it has a built-in correction for the wear on the seal. With other words, there will be an automatic adaptation to the degree of wear on the seal without the need for additional measurements or adjustments.

Figure 6:
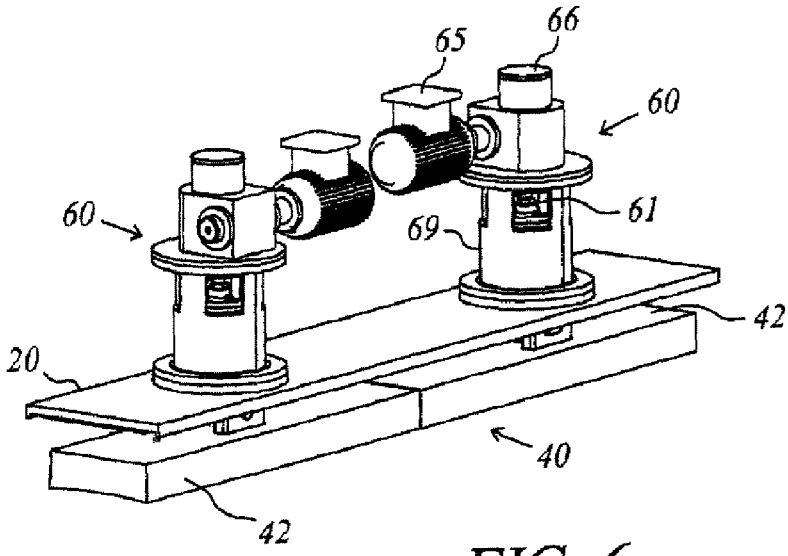
FIG. 6 is a side, perspective view of a longitudinal seal provided with two units for seal adjustment in accordance with a preferred embodiment of the present invention.

According to an embodiment of the present invention, the mechanism for seal adjustment comprises more than one unit for seal adjustment per seal. This is illustrated in FIG. 6, which shows a longitudinal seal 40 provided with two units 60 for seal adjustment, one in the vicinity of each end. These units 60 are preferably provided with functionally separate, i.e. individually controlled, moving means, whereby different parts 42 of the seal 40 can be moved independent of each other. (The moving means in FIG. 6 is partly surrounded by the support structure 69, but its motor 65 and jackscrew 66 are shown.) In this way, an appropriate sealing is achieved also in cases where the seal 40 e.g. is unevenly worn or where there are objects between the seal 40 and the drum (10 in FIG. 4A) that only affect a part of the seal 40. In order to facilitate movement of the respective seal part 42, the connection between the cylinder and the seal 40 is in this case preferably pivoted. The movement of the cylinder is still substantially in the radial direction of the drum.

As mentioned earlier, the longitudinal seal 40 is, according to a preferred embodiment, made of a polymer material. In this manner, a supporting metal sheet or the like (not shown) of a more rigid material may be arranged in connection with the seal in order to prevent unwanted bending thereof. Embodiments where there are intermediate parts between the seal and the casing 20 thus lie within the scope of the present invention.

Again referring to FIGS. 4A and 4B, the unit 60 for seal adjustment according to the present invention can be provided with a spring means 68, typically arranged at or inside the cylinder 67 with a movable part closest to the drum and a fixed point furthest away from the drum 10. The spring package 68 is suitably biased such that it can come into force and provide a rapid movement of the seal 40 away from the drum. The bias can, for example, be of such a range that it is more than double the size of the "normal" force against the seal. This is illustrated in FIG. 5B, where the threshold for the spring washers is $F_{spring}$. This solution implies that the motor (or an alternative drive means) can be of a manageable size. The spring means works as a rough emergency measure in order to enable movement of the seal, for instance in case the motor is not working and an object enters between the seal and the drum. Furthermore, upon rapid and substantial changes it may be the case that the system does not have time to react; the drive means does not receive a control signal in time. In such cases, the spring means may act as a safety function, which allows the seal to move away from the drum. However, it should be understood that the spring means is an optional part of the seal adjustment, which according to some embodiments may be excluded.

A spring means of the above-described type works as a kind of mechanical "shock absorber", which allows the seal to move when it is subject to comparatively large forces. As opposed to the safety function accomplished by means of the threshold $F_{max}$, which threshold is typically set in the control system/computer, the spring means will work also when the control system is down, such as when the power supply is not working. According to a preferred embodiment of the present invention, the unit for seal adjustment is provided with both these safety functions, whereby $F_{spring}>F_{max}$, but embodiments lacking one or both of the functions are also possible.

An alternative embodiment of the present invention uses indirect force measuring instead of direct force measuring. Indirect force measuring means measuring a parameter other than the force itself but which is dependent on, and thus serves as an indication of the force against the longitudinal seal. In a hydraulic system where the seal is positioned by means of hydraulic cylinders it is, for example, possible to utilize pressure impulses caused in the liquid (e.g. oil) of the cylinder by the force against the seal. According to one such embodiment, the pressure is registered by at least one pressure sensor arranged in the vicinity of the longitudinal seal. (There may also be embodiments where the pressure sensor is located at distance, registering pressure pulses in liquid connected with the hydraulic liquid in the positioning cylinder.) This results in a pressure pulse signal, the pulse height (e.g. peak-to-peak value, "dP") of which increases the closer to the drum to seal gets. A pulse height parameter from such a diagram can be used in a corresponding way as the pulse height parameter from a pulse signal of the actual force against the seal.

Figure 7:
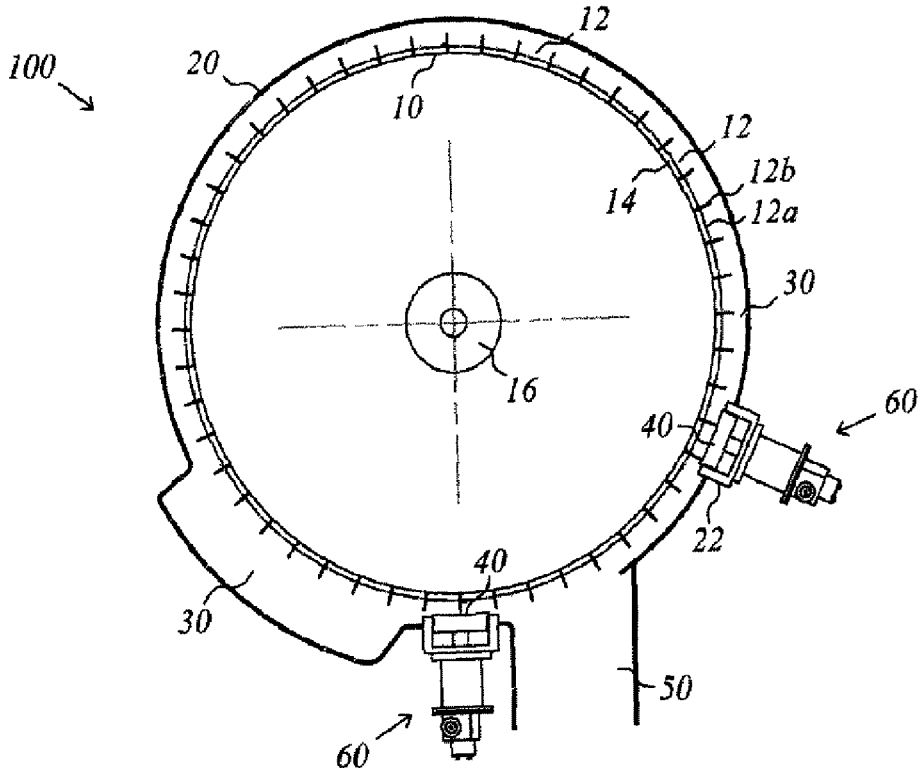
FIG. 7 is a side, elevational, cross-sectional view through a washing apparatus having a compartmented drum in accordance with a preferred embodiment of the present invention.

Yet another embodiment of the present invention provides safer sealing function of the washing drum in cases where there are a plurality of units 60 for seal adjustment. The units 60 may be arranged in association with the same (FIG. 6) or different seals (FIGS. 3 and 7) and during normal operation they operate independent of each other without any communication between them. However, according to this embodiment it is suggested that the control of one seal 40, e.g. when its accompanying load cell 61 is not working, instead can be based on the force that is measured with respect of another seal 40/seal part 42. Preferably, the control function is designed such that it, when force measurements from one load cell 61 are not available, first uses the force from another load cell measuring on the same seal. If there is no such load cell or if it does not work, measurement values from a load cell measuring on another seal of the washing drum are used instead. Although the seal adjustment will in general not be as precise as when all load cells are working, it can in this way become better as compared to if the self-sensing seal function would be completely disconnected.

There may also be embodiments of the present invention where some longitudinal seals of the washing apparatus are provided with units for seal adjustment while others lack this functionality. Of course, such embodiments also lie within the scope of the present invention. In general, it is most important to optimize the function of the seals which are adjacent to a forming zone and discharge zone, respectively, of the drum. Consequently, according to an embodiment of the present invention, illustrated in FIG. 7, there is seal adjustment in accordance with the present invention only in association with the first and the last seal of the washing apparatus.

Figure 8:
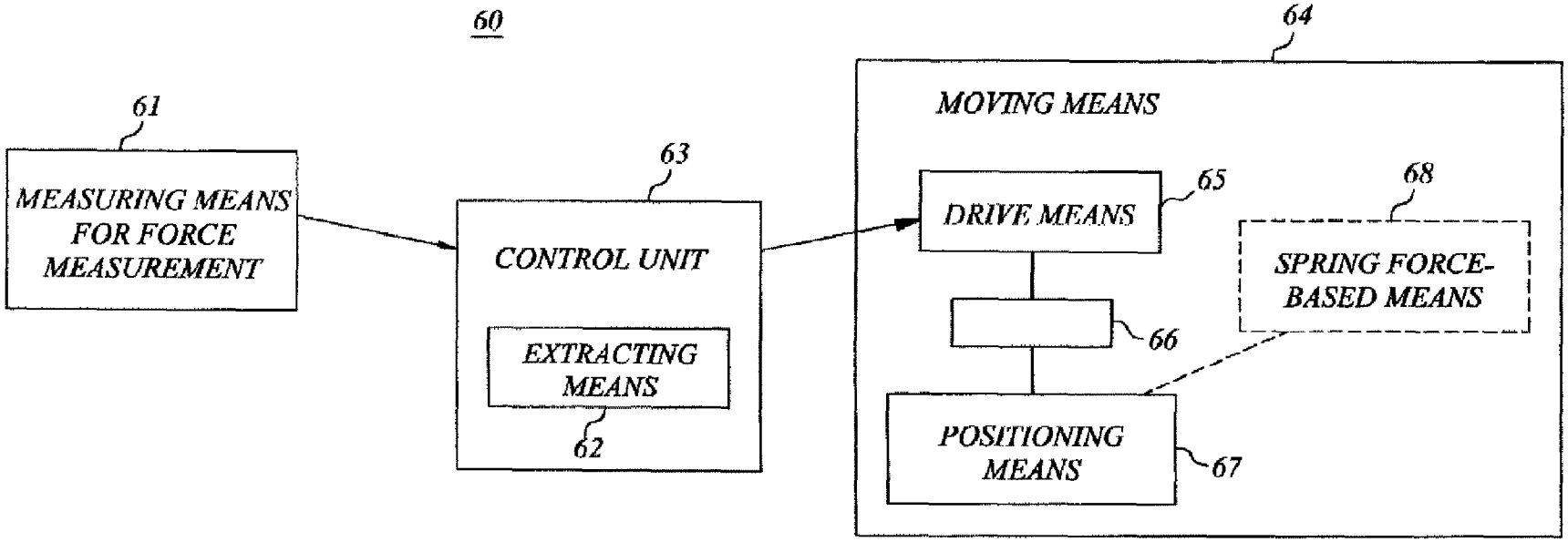
FIG. 8 is a schematic block diagram of an apparatus for seal adjustment in accordance with a preferred embodiment of the present invention.

FIG. 8 is a schematic block diagram of a unit for seal adjustment according to a preferred embodiment of the present invention. The illustrated unit 60 for seal adjustment comprises a measuring means 61 for direct or indirect force measurement, e.g. a load cell or a pressure sensor, from which measurement signals are brought to a control unit/function 63, e.g. a computer program with specially adapted control algorithms. Normally, this occurs automatically at selected, comparatively small, time intervals, providing a substantially continuous seal adjustment. The unit 60 for seal adjustment comprises an extracting means 62, adapted to extract (i.e. read, compile, calculate) one or more pulse height parameters from the signal registered by the measuring means 61. The extracting means 62 is preferably computer-based and integrated with the control unit as in FIG. 8. However, other embodiments are also possible.

The control unit 63 normally also comprises functionality (not shown) for filtering, or equivalent processing, of the pulse signal. This functionality removes noise/disturbances and thereby facilitates the extracting of the pulse height information. The system can also comprise attenuation of the signal before further processing/evaluation. However, filtering and similar signal processing is not mandatory.

The control unit 63 in turn communicates with a drive means 65, which drives the movement of the seal and thus form a part of the moving means 64 of the unit 60. The drive means 65 can for example consist of an electric motor or a hydraulic drive unit. The position of the seal is controlled by transferring the drive movement of the drive means 65 to a positioning means 67, e.g. a cylinder physically connected to the seal and arranged to hold the seal in the desired position in a substantially radial direction. This can be done directly or via one or more intermediary members 66. An example of such an intermediary member is the jackscrew in FIGS. 4A and 4B, but depending on i.a. the nature of the drive means 65, other functional units may be used to translate the drive force to movement at the positioning means 67.

As mentioned above, the moving means 64 can also comprise a spring force-based means 68, which, via the positioning means 67, enables movement of the seal upon significant changes of the force against the seal. The spring force-based means 68 may often be excluded, which in FIG. 8 is indicated by dashed lines.

Figure 9:
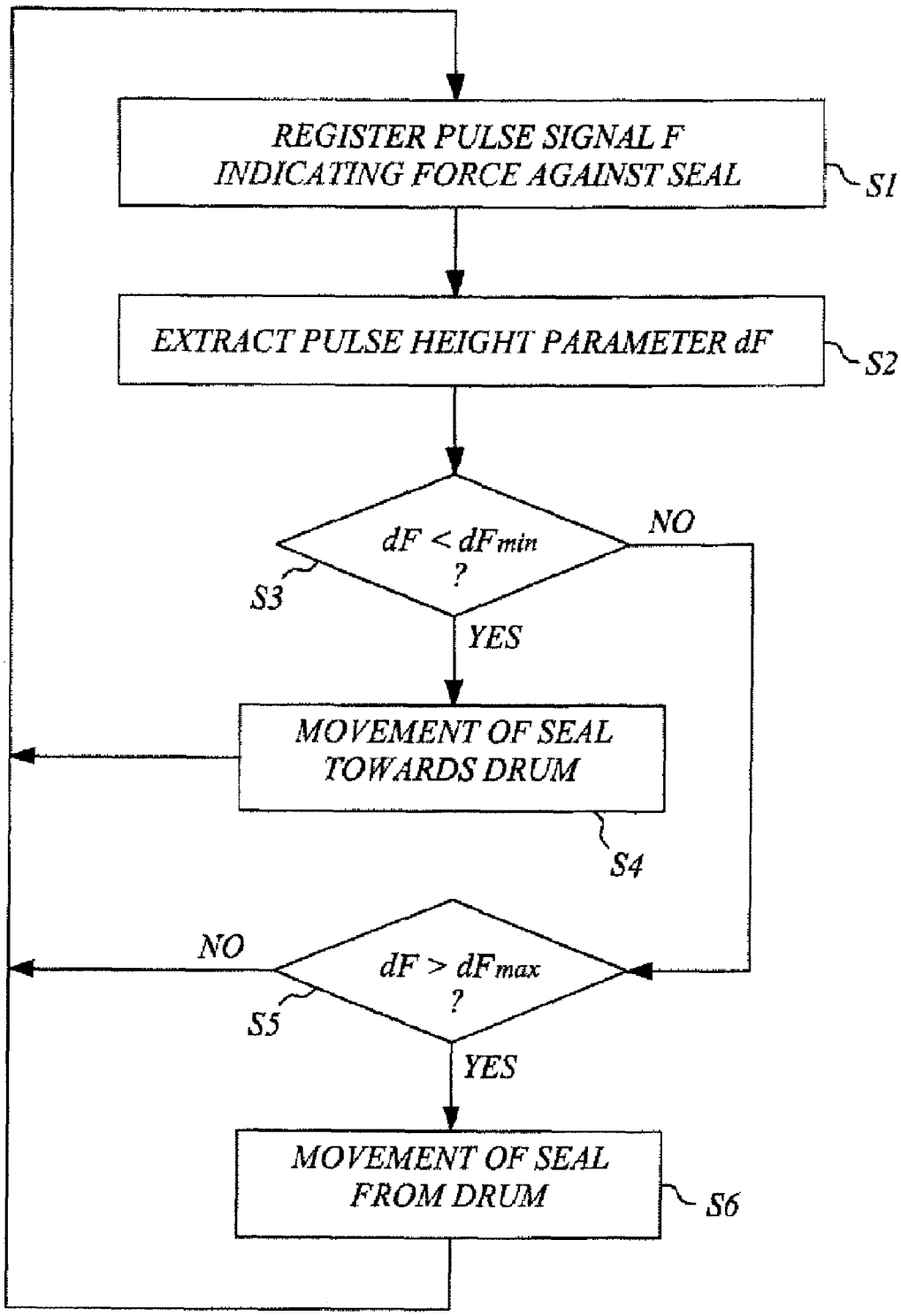
FIG. 9 is a schematic flow chart of a method for seal adjustment in accordance with a preferred embodiment of the present invention.

FIG. 9 is a flow chart of a method for seal adjustment according to an exemplifying embodiment of the present invention. In a first step S1, a pulse signal, for example a force pulse signal, is registered through more or less continuous measurement. From the pulse signal is extracted a pulse height parameter dF that in general reflects the pulse height for a number of pulses back in time (S2). Movement occurs if the pulse height parameter dF is smaller than a minimum value or larger than a maximum value. In step S3, the pulse height parameter is therefore compared against a minimum value of the pulse height $dF_{min}$. If it is less than the minimum value $dF_{min}$, the system reacts by moving the seal against the drum (S4). There is also, in step S5, a comparison against a maximum value of the pulse height $dF_{max}$. If the max value $dF_{max}$ is exceeded, the system reacts by moving the seal from the drum (S6).

The movement in S4 and S6 can e.g. be as a specific predetermined distance or proportional to the deviation. According to one embodiment the system only reacts when pulse height parameter has been less than the minimum value or larger than the maximum value for a certain period of time.

As shown by the arrows back to step S1, the flow chart of FIG. 9 relates to a method for seal adjustment that is substantially continuous. The steps are performed in a substantially continuous manner and normally also at least partly simultaneously as compared to each other. Nevertheless, it is to be understood that continuous adjustment does not necessarily mean continuous movement. The seal may also in this case be kept at the same position for a long time period. Movement occurs when needed but the position is continuously checked.

Expressions used in this description, such that the seal is in contact with or lies in (close) contact with or bears against the compartment walls/drum and the similar, refers to direct as well as indirect contact between seal and compartment walls. Thus, there does not necessarily have to be any physical contact directly between the seal and the compartment walls/drum for these conditions to be fulfilled. For example, the seals may be arranged at a certain distance from the drum and its compartment walls, whereby the contact arising from the meeting with the compartment walls occurs via the pulp compressed in the compartments. It can also be the case that there is an object, such as a chip or a metal sheet part, between the seal and the compartment walls.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A method for adjusting the seal in a washer for washing and dewatering a cellulose pulp comprising a rotatable drum including a plurality of axial compartment walls distributed along the circumference of said drum defining a plurality of outer compartments for washing said cellulose pulp, a stationary cylindrical casing enclosing said drum, defining an annular space between said stationary cylindrical casing and said rotatable drum, and at least one axially disposed seal dividing said annular space into a plurality of zones for forming, washing and discharging said pulp, said method comprising:

registering a pulse signal indicating the force acting on said at least one axially disposed seal in a direction relative to said drum, said pulse signal corresponding to forces acting between said plurality of axial compartment walls and said at least one axially disposed seal;

deriving a relative pulse height parameter comprising a difference between two absolute values from said registered pulse signal; and moving said at least one axially disposed seal substantially in the radial direction of said drum in a predetermined manner based on said relative pulse height parameter.

2. The method according to claim 1, wherein said relative pulse height parameter is based on the difference between a peak value and a balanced position or on the difference between the peak values of said pulse signal.

3. The method according to claim 1, wherein said pulse signal comprises a force signal registered by measuring the force acting on said at least one axially disposed seal in a direction relative to said drum.

4. The method according to claim 1, wherein said pulse signal comprises a pressure signal registered by measuring the pressure in the liquid of a hydraulic system.

5. The method according to claim 1, comprising substantially continuously registering said pulse signal and adjusting said at least one axially disposed seal when said washer is operating.

6. The method according to any claim 1, wherein said moving of said at least one axially disposed seal occurs if said relative pulse height parameter is smaller than a predetermined minimum value or larger than a predetermined maximum value.

* * * * *

UNITED STATES PATENT AND TRADEMARK OFFICE

CERTIFICATE OF CORRECTION

PATENT NO. : 8,303,770 B2
APPLICATION NO. : 12/516429
DATED : November 6, 2012
INVENTOR(S) : Jonas Orgård It is certified that error appears in the above-identified patent and that said Letters Patent is hereby corrected as shown below:

In the Specification

Column 4, line 25, “self sensing” should read --self-sensing--.
Column 4, line 37, delete “is” and insert therefor --are--.
Column 8, line 46, delete “is” (second instance) and insert therefor --it--.
Column 8, line 55, “self sensing” should read --self-sensing--.
Column 9, line 31, delete “are” and insert therefor --is--.
Column 11, line 60, after “at” insert --a--.
Column 12, line 55, delete “is” and insert therefor --are--.
Column 13, line 42, “refers” should read --refer--.
Column 14, line 47, delete “any”.

Signed and Sealed this
Twentieth Day of May, 2014

Michelle K. Lee

Michelle K. Lee
*Deputy Director of the United States Patent and Trademark Office*